United States Patent [19]

Kaneko et al.

[11] 4,044,860

[45] Aug. 30, 1977

[54] ELEVATOR TRAFFIC DEMAND DETECTOR

[75] Inventors: Takashi Kaneko; Tatsuo Iwasaka, both of Katsuta, Japan

[73] Assignee: Hitachi, Ltd., Japan

[21] Appl. No.: 658,894

[22] Filed: Feb. 18, 1976

[30] Foreign Application Priority Data

Feb. 21, 1975 Japan ..... 50-20948

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,065,823 | 11/1962 | Burgy | 187/29 |
| 3,176,797 | 4/1965 | Dinning | 187/29 |
| 3,207,266 | 9/1965 | Hornung | 187/29 |
| 3,967,702 | 7/1976 | Iwasaka et al. | 187/29 |
| 3,973,649 | 8/1976 | Iwasaka et al. | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

The detection of traffic demand for elevator cars serving a plurality of floors is related. A device is provided for detecting the latest information on traffic demand based on the number of passengers actually boarding and alighting from cars (herein-after referred to as the "boarding and alighting passengers"). On the basis of the respective floors at which cars are stopped to serve, the direction of travel of the cars, and the number of passengers boarding and alighting from the cars at the respective floors, the number of boarding and alighting passengers by direction is detected for each floor. The detected numbers for the respective floors are totaled to detect the traffic demand at each floor by direction. Further, the total is made for each traffic demand pattern to detect the traffic demand at each floor by traffic demand pattern and by direction. By taking the cumulative total of the totaled numbers of boarding and alighting passengers for all the floors by direction, the total number of boarding and alighting passengers is calculated. The results of these calculations are used to detect various types of information on traffic demand.

12 Claims, 18 Drawing Figures

ELEVATOR TRAFFIC DEMAND DETECTOR

The present invention relates to the detection of elevator traffic demand and in particular to an apparatus for detecting information on elevator car passengers.

Various types of information on traffic demand are required for greatly improved elevator control in order to assure improved elevator service by shortening the elevator car waiting time and preventing the case where prospective passengers are left behind because of the arriving cars being loaded to full capacity.

To shorten the elevator waiting time and to prevent such inconveniences as the left-behind condition, it has recently been suggested that how many of the hall-waiting prospective passengers taking a given car is destined for which floors should be forecase, thereby calculating the forecast future in-cage passenger number. Also, a system is being considered whereby the number of prospective passengers expected to gather on the hall of a given floor to take a car is capable of being forecast. For these forecasting calculations, such types of information on traffic demand as the destination ratio which is indicative of the rates at which hall-waiting prospective passengers are destined for given floors and the rate at which prospective passengers appear at each floor.

The above-mentioned types of information on traffic demand, however, cannot be obtained instantaneously unlike the traffic information such as the presence or absence of a call, the car-operating conditions (including car position and direction of travel thereof) and the in-cage passenger number. The recent trend, therefore, is that such types of information on traffic demand are preset manually according to personal judgement.

In spite of this, it is very difficult to completely grasph, in the stage of elevator installation planning, the whole picture of traffic demand for cars which will operate in the future. Even after the starting of actual operation, the conditions for traffic demand are subjected to a considerable change every year. As a result, the information on traffic demand set manually according to personal judgement cannot meet the prevailing condition, thereby making necessary frequent readjustment of traffic demand information set previously.

Accordingly, it is an object of the present invention to provide an apparatus for automatically detecting the traffic demand by direction of car travel for each floor, thereby making possible greatly improved elevator car control operation for assurance of superior elevator service taking into consideration the traffic demand for each floor.

Another object of the invention is to provide an apparatus for detecting, by car demand pattern, the above-mentioned elevator car traffic demand by direction for each floor, thereby making possible the greatly improved elevator control and superior elevator service taking into consideration the traffic demand by direction for each floor according to each demand pattern.

Still another object of the invention is to provide an apparatus for detecting from the above-mentioned detected values not only the elevator traffic demand by direction of car travel but also various types of traffic demand information including the rate of boarding and alighting passengers by direction for each floor, and the number of boarding and alighting passengers per unit time, thereby making possible superior elevator service and greatly improved elevator control operation.

According to one aspect of the present invention, the floor at which a given car has served, the direction of travel of that car and the number of passengers boarding and alighting from the car at the floor are detected. The detected numbers of boarding and alighting passengers are totaled thereby to detect the traffic demand by direction of car travel for each floor.

According to another aspect of the invention, the above-mentioned cumulative total of the numbers the boarding and up passengers is taken by demand pattern, thereby detecting the traffic demand by direction of car travel for each floor for each demand pattern.

A third feature of the invention lies in the fact that the total numbers of passengers boarding and alighting at respective floors as detected above are totaled for all the floors and that the cumulative total of the passenger number for all the floors are compared with the number of boarding and alighting passengers for each floor and other various calculating operations performed to obtain the rate of boarding and alighting passengers for each floor.

The above and other objects, features and advantages as well as methods for simplifying the apparatus will be made apparent by the detailed description taken in conjunction with the accompanying drawings, in which:

FIGS. 12 to 17 show an embodiment of the present invention in which:

FIG. 12 is a diagram showing a circuit for calculating the number of boarding-and-alighting passengers by direction for each floor for a predetermined period of time, the up travel at the 2nd floor being involved in the shown circuit;

FIG. 13 shows a circuit for calculating the total number of boarding-and-alighting passengers by direction;

FIG. 14 shows a circuit for calculating the rate of boarding-and-alighting passengers by direction for each floor, the 2nd-floor up travel being involved in the shown circuit;

FIG. 15 shows a circuit for calculating the number of boarding and alighting passengers by direction for each floor per unit time, the 2nd-floor up travel being involved in the shown circuit;

FIG. 16 shows a circuit for calculating the number of passengers by direction for each floor according to each demand pattern, who board and alight from the cars during a predetermined period of time, the 2nd-floor up travel being involved in the shown circuit;

FIG. 17 shows a circuit for calculating the number of passengers by direction for each floor according to each demand pattern who board and alight from the cars during a unit time, the 2nd-floor up travel being involved in the shown circuit;

Prior to entering the explanation of specific constructions of the apparatus according to the invention, the general construction thereof will be described below with reference to the block diagram of FIG. 1.

Figure 1:
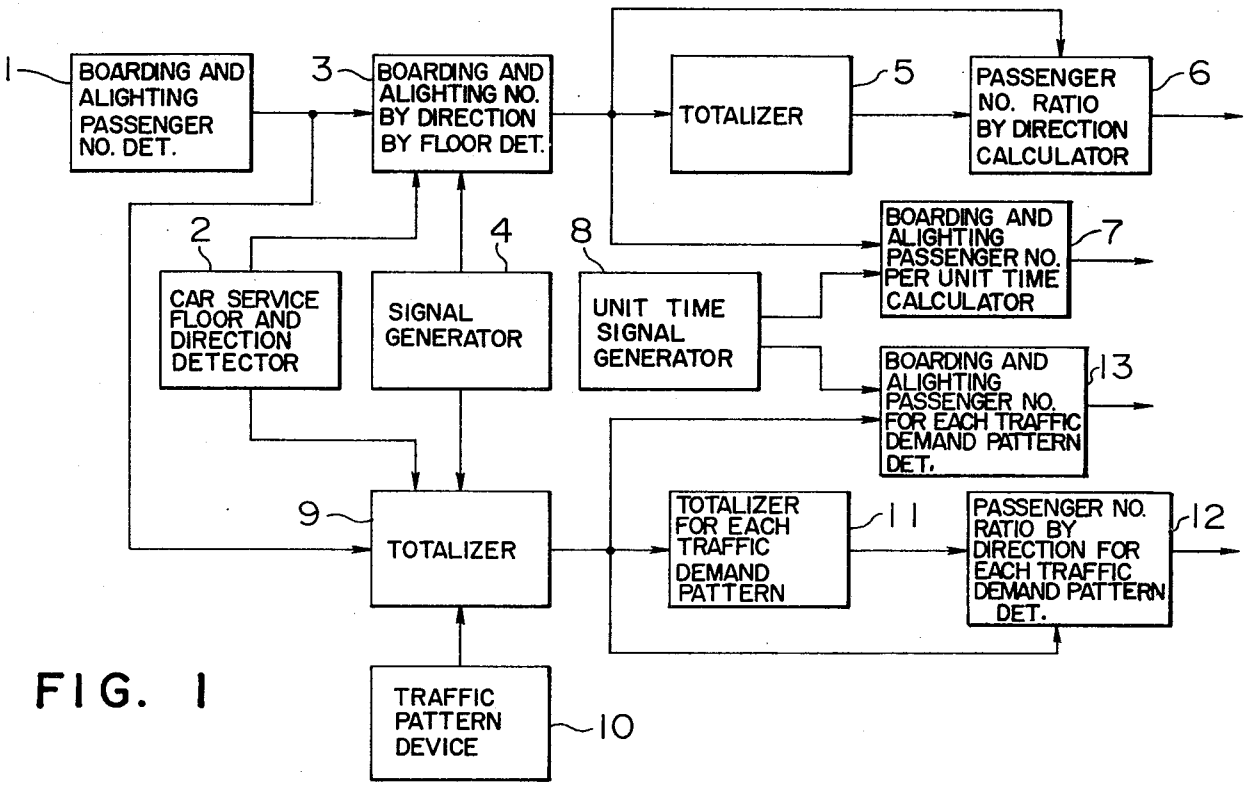
FIG. 1 is a block diagram for briefly explaining the traffic demand detector according to the present invention.

In FIG. 1, a device 1 for detecting the number of passengers boarding and alighting each time of service of a car and a device 2 for detecting the floors served by and direction of the car are used to detect the number by direction for each floor, of the passengers boarding and alighting each time of car service. The number of boarding and alighting passengers thus detected for each floor totaled by direction.

By doing so, the number of persons who have boarded and alighted from an elevator car after the starting of elevator car operation is detected by direction for each floor. A set period signal generator 4 is for producing a signal after the lapse of a predetermined period of time following the starting of elevator operation and for resetting the number of boarding-and-alighting passengers by direction which is totaled for each floor in a device 3. If the traffic condition in the building in question changes some time after the starting of elevator car operation, for instance, the number of boarding and alighting passengers by direction for each floor which is already registered for the previous traffic condition is required no longer. If accumulation is continued without resetting the registered number of passengers the accuracy in detection will be reduced. The signal generator 4 is thus used to clear the registered cumulative total and to detect the number of boarding and alighting passengers by direction for each floor which is most suitable for the new traffic condition of the building. As an alternative, the signal generator 4 may be adapted to produce a signal automatically at regular intervals of time, for example, every month or every several months. In this way, it is possible always to detect the number of boarding and alighting passengers by direction for each floor which meets the prevailing condition.

A device 5 is for totaling, in response to the totaled number of boarding and alighting passengers by direction for each floor, the number of boarding and alighting passengers by direction for all the floors, thereby detecting the total number of boarding and alighting passenges by direction. The car demand situation by direction passengers car travel is thus detected. A device 6 is provided for the purpose of calculating the rate of the number of boarding and alighting passengers by direction for each floor, from the above-mentioned total number of boarding and alighting passengers by direction and the number of boarding and alighting passengers by direction for each floor. In other words, for the same direction of travel, the rate of the number of boarding and alighting passengers at every floor is calculated. This makes it possible to detect the traffic condition and traffic characteristics by direction for each floor. Further, a device 7 is for calculating, in response to a unit time signal from a unit time signal generator 8 and the above-mentioned number of boarding and alighting passengers by direction for each floor, the number of persons who get on and off the cars at each floor during each unit time. It is thus possible to know the state of traffic by direction for each floor per unit time.

A device 9, on the other hand, like the device 3 for detecting the number of boarding and alighting passengers by direction by floor, receives signals from the device 1 for detecting the number of boarding and alighting passengers each time of car service, the device 2 for detecting the service floors and direction of travel, the device 4 for producing a signal for the predetermined period of time. The device 9 further receives from a traffic pattern device 10 a signal representing the traffic demand pattern. In this way, the number of boarding and alighting passengers by direction for each floor it totaled according to different traffic demand patterns. In other words, the number of boarding and alighting passengers by direction for each floor for each traffic demand pattern is detected. The reason for detecting the passenger number for each pattern lies in the fact the passengers behave differently at different times of the day including the morning rush hours, the evening rush hours, the lunch recess and intermediate hours. If the number of boarding and alighting passengers by direction for each floor is detected by the device 3 regardless of the traffic demand patterns, the result is always an average number of boarding and alighting passengers. Because of the quite different passenger behaviour in the morning from that in the evening rush hours, the detection of an average number of boarding and alighting passengers as mentioned above is not advisable for optimum elevator control meeting the prevailing situations.

Taking this fact into consideration, the device 9 is so arranged as to detect the number of boarding and alighting passengers by direction for each floor according to each traffic demand pattern.

Devices 11 to 13, like the device 5 to 7 calculate the total nummber of boarding and alighting passengers, the rate of the number of boarding and alighting passengers, and the number of boarding and alighting passengers per unit time according to each traffic demand pattern, respectively.

As briefly explained above with reference to the block diagram of FIG. 1, according to the present invention new information is automatically provided based on the number of boarding and alighting passengers as the information on traffic demand.

The present invention will be described below with reference to a specific embodiment.

Figure 2:
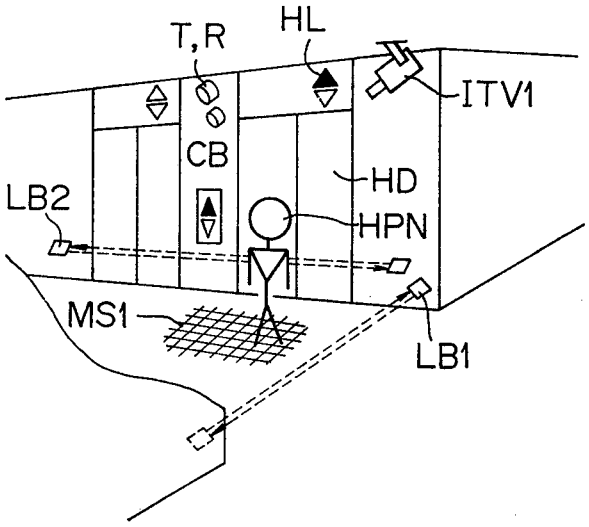
FIG. 2 is a schematic diagram showing an elevator hall to which the present invention is applied.
Figure 3:
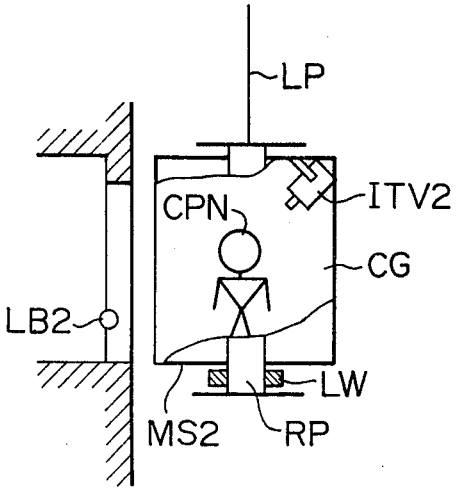
FIG. 3 is a sectional view showing an elevator hall and an elevator cage to which the present invention is applied.

An outline of the elevator hall and sectional diagrams of the elevator hall and the cage are shown in FIGS. 2 and 3 respectively. In these drawings, reference character HL represents a well-known hall lantern, CB a call button, HD a door allowing access to the elevator cage, LP, a rope, CG a cage, RP an outer frame, HPN a hall-waiting prospective passenger and CPN an in-cage passenger.

The number of passengers getting on a given car serving a given floor can be detected by any of the following boarding passenger number detectors:

1. A plurality of photo-electric beams are produced from a photo-electric device LB2 arranged at the car entrance of each floor. Every time the beams are cut off in the direction from the hall side toward the cage, a count is made. From the number of counts thus made during period from the arrival of a car to the leaving thereof, the number of passengers who have boarded the car at the particular floor is detected.

2. The number of prospective passengers waiting on an elevator hall is detected either by the number of switch units energized among a multiplicity of switch units making up a mat switch MS1 laid on the floor surface of the elevator hall, by processing the picture on an industrial television camera ITV1 arranged directed to the elevator hall, or by counting the number of times when the photo-electric beams produced from a photo-electric drive LB1 disposed at the entrance of the elevator hall are cut off as explained in (1) above. Thus the number of hall-waiting prospective passengers detected at the time of car arrival (for example, immediately before opening the door) is considered to be the number of passengers boarding the car at the particular floor.

3. In a recently suggested method, an ultrasonic transmitter-receiver T, R is installed on the elevator hall to detect the number of hall-waiting prospective passengers with high accuracy, and the detected number of hall-waiting prospective passengers is used as the number of new passengers who have got on the car at the particular floor.

This method for detecting the number of waiting prospective passengers by the use of the ultrasonic transmitter-receiver T, R will be explained below with reference to the block diagram of an embodiment and the signal waveform diagram of FIGS. 4 and 5 respectively.

Figure 4:
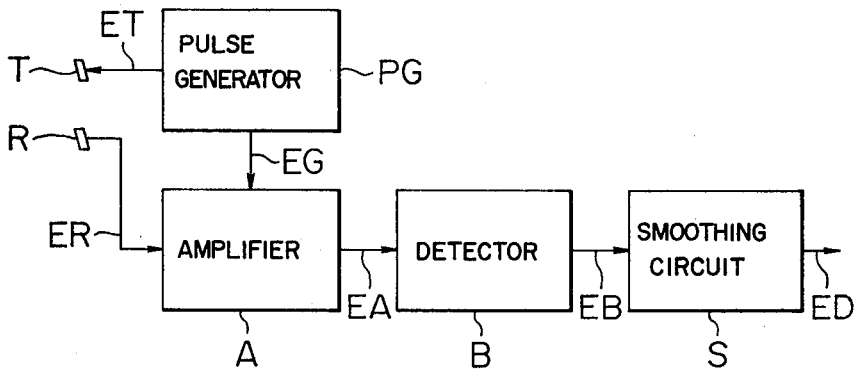
FIG. 4 is a block diagram showing the hall-waiting prospective passenger number detector using an ultrasonic transmitter-receiver according to an embodiment of the invention.
Figure 5:
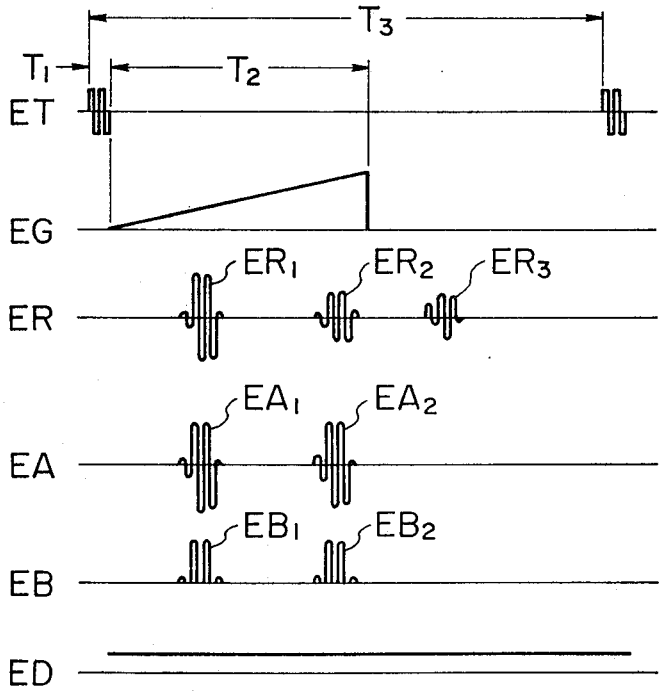
FIG. 5 shows signal waveforms produced at various parts of the block diagram of FIG. 4.

A pulse generator PG shown in FIG. 4 produces a transmission signal ET and a gain signal EG as illustrated in FIG. 5. The wave transmitter T transmits ultrasonic wave for the period of generation of transmission signal ET. The transmission signal ET is obtained by taking out a portion of an alternating current in the ultrasonic range of about 25 KHz in frequency for a short period of time $T_1$ (about 0.2 ms) and has a repetition period of $T_3$. The gain signal EG is a triangular wave starting upon completion of the transmission wave signal EG and increasing in linear fashion for the period of time $T_2$ and takes the value of zero from $T_2$ to $T_3$.

The receipt signal ER which is an output voltage of the wave-receiver R includes a wave $ER_1$ reflected from a nearby person, a wave $ER_2$ reflected from a person far away, and an unnecessary wave $ER_3$ reflected from a wall or the like farther away. It will be self-explanatory that the wave $ER_2$ is smaller than $ER_1$. The receipt signal ER is amplified by an amplifier A which produces an output EA. The amplifier A is a variable gain amplifier, the gain of which is proportional to the gain signal EG. In other words, the relation $EA \propto EG \cdot ER$ is established, and therefore the amplifier A may be considered to be an analog multiplier for making a product of the signal EG and signal ER.

By the operation of the amplifier A and the gain signal EG, the magnitude of the signals $EA_1$ and $EA_2$ in the amplifier output EA corresponding to $ER_1$ and $ER_2$ respectively may be made almost constant. Since the wave $ER_3$ reflected on the distant wall is received later than the time point $T_2$, the signal corresponding to the $ER_3$ does not appear in the amplifier output EA. This function is capable of eliminating the unrequired signals arriving from out of the detection area.

Next, only the positive portion of the amplifier output EA is taken out by a detector B. The detector output EB is transformed into a signal ED proportional to the number of waiting prospective passengers through a smoothing circuit S. The time constant of the smoothing circuit S is sufficent large as compared with the repetition period $T_3$ of the transmission pulses, and therefore the signal ED is a DC voltage equal to the average value of the detection output EB. The receipt signal ER from the hall-waiting prospective passenger HPN is smoothed after being shaped into the same waveform regardless of the positions of the hall-waiting prospective passenger HPN, so that the signal ED is a value proportional to the number of hall-waiting prospective passengers HPN.

In the above-mentioned way, the number of hall-waiting prospective passengers can be detected.

Figure 6:
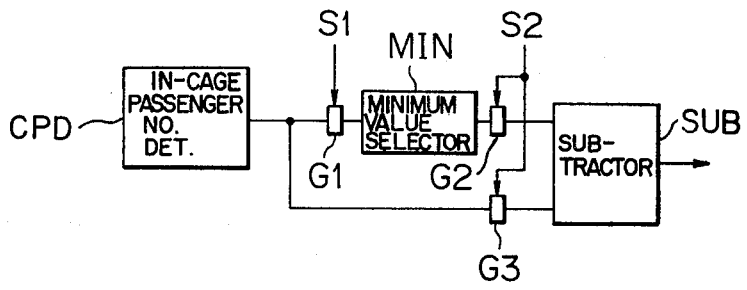
FIG. 6 is a circuit diagram showing the boarding passenger number detector according to an embodiment of the invention.
Figure 7:
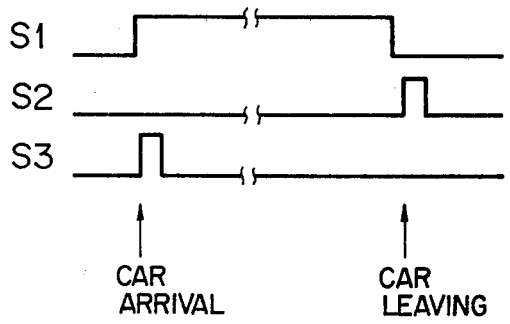
FIG. 7 is a timing chart for explaining the embodiment of FIG. 6.
Figure 8:
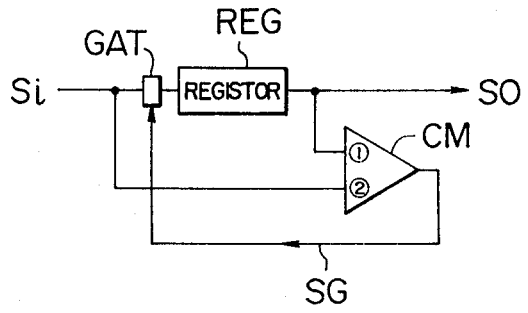
FIG. 8 is a circuit diagram showing an embodiment of the minimum value selector circuit.

4. A method for detecting the number of in-cage passengers is by the use of an in-cage passenger number detecting device CPD. The in-cage passenger number detecting device CPD may be composed of a weighing device LW as shown in FIG. 3, or an industrial television camera ITV2 or a mat switch MS2 in the same manner as the case of detection of hall waiting passenger number. The detecting operation is performed by the construction as shown in FIG. 6. By the way, the time chart of gate signals S1 to S3 is shown in FIG. 7. In FIG. 6, the signal S1 appearing from the arrival of the car to the leaving thereof (for example, during the time the door is open) is in the state of 1. The output signal of the in-cage passenger number detector CPD for the arriving car is applied through a gate element G1, which is enabled to pass the signal applied thereto therethrough only during the 1 state of the gate signal S1, to the well-known minimum value selector circuit MIN, so that the minimum value Pmin of the in-cage passenger number during the above-mentioned period is selectively produced. At the time of car start (for example, when the door is closed), a predetermined pulse S2 in the state of 1 is produced. The output P of the in-cage passenger number detector and the output Pmin of the minimum-value selector circuit MIN at that time are applied to a subtractor SUB through gate elements G2 and G3, where the subtracting operation P minus Pmin is made thereby to detect the number of new passengers who board the car at the particular floor. The subtractor SUB may be one of well-known type and will not be described, while, an embodiment of the minimum value selector circuit MIN will be explained with reference to FIG. 8. In FIG. 8, a gate element GAT is enabled to pass therethrough a signal applied thereto only in response to the 1 state of a gate signal SG. A register REG is a memory for storing and producing an input signal applied thereto, and a comparator CM produces a 1 signal when the signal applied at an input terminal ② is smaller than that applied at an input terminal ①. Assuming that an input signal Si is larger than the signal SO stored in the register REG, the output signal SG of the comparator CM is 0 and therefore the gate element GAT is prevented from passing therethrough the input signal Si to the register REG. As a result, the registered signal SO of the register REG remains unchanged. In the event that the signal Si is smaller than the signal SO, by contrast, the output signal SG of the comparator CM is 1, and the gate element GAT is opened to transfer the signal Si to the register REG, thereby renewing the registered signal therein. In this way, the output signal SO of the register always takes the minimum value of the input signal Si. Next, the number of passengers getting off the car when it reaches a floor can be detected in the following manner.

5. Contrary to the method (1) mentioned above, only when the photo-electric beams produced from the photo-electric device LB2 arranged at the car entrance are cut off in the direction from the car side toward the hall, it is counted. And by counting the number of times they are cut off, the number of passengers who alight from the car is detected.

Figure 9:
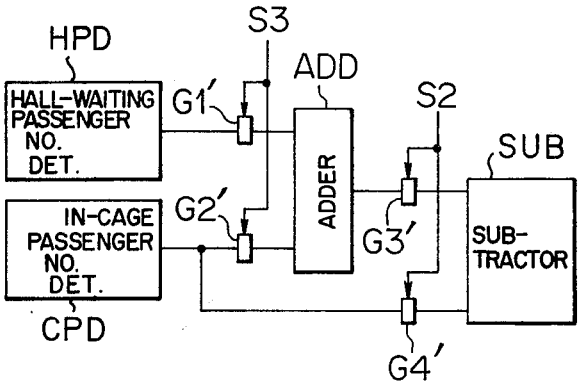
FIG. 9 is a circuit diagram showing an embodiment of the alighting passenger number detector according to the present invention.

6. As shown in FIG. 9, when a car arrives at a floor, a predetermined 1 pulse signal S3 is produced. Both the output signals from the hall-waiting passenger number detector HPD described above in items (2) and (3) and the in-cage passenger number detector CPD, namely, the number of hall-waiting prospective passengers immediately before car arrival and the number of in-cage passengers are applied through gate elements G1′ and G2′ to an adder ADD for addition and storage therein. Further, a predetermined 1 pulse signal S2 is produced at the time of the car leaving the particular floor. The output signal H of the adder ADD and the output signal P of the device CPD, namely the number of in-cage passengers at the time of leaving the floor, are applied through gate elements G3′ and G4′ to the subtractor SUB where the subtracting operation H minus P is performed thereby to detect the number of passengers who got off the car at the floor in question.

Figure 10:
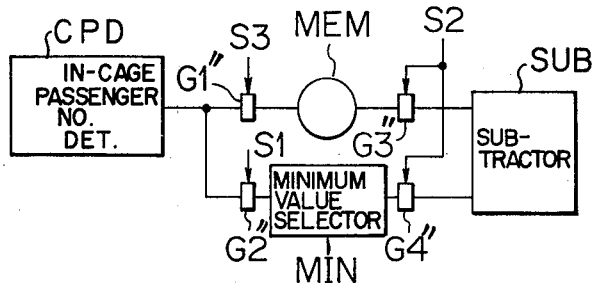
FIG. 10 is a circuit diagram showing another embodiment of the alighting passenger number detector according to the present invention.

7. As illustrated in FIG. 10, a predetermined 1 pulse signal S3 is produced at the time of car arrival. The output signal of the in-cage passenger number detector CPD is applied through a gate element G1″ to a memory MEM and stored therein. The information stored in the memory MEM thus represents the number of passengers in the car at the time of its arrival. Also, during the time period from the arrival at the floor to the starting from it, a 1 signal S1 is produced, so that the output signal from the device CPD is allowed to pass through a gate element G2″ so as to be applied to the above-mentioned minimum-value selector device MIN thereby to select a minimum value for the particular period. In other words, the output signal of the minimum-value selector MIN represents the minimum value of the number of in-cage passengers during the car stoppage at the floor in question. when the car leaves the floor, a predetermined 1 pulse signal S2 is produced, so that the output signal M of the memory MEM and the output signal Pmin of the minimum-value selector MIN are allowed to pass through gate elements G3″ and G4″ so as to be applied to the subtractor SUB for the subtracting operation M minus P min. In this way, the number of passengers who have get off the car at the particular floor is detected.

Figure 11:
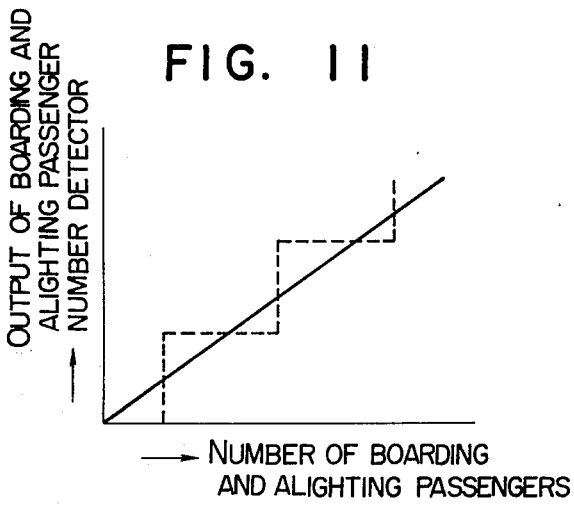
FIG. 11 is a diagram showing the input-output characteristics of the boarding-and-alighting passenger number detector.

The input and output characteristics of the boarding pasenger number detector and the alighting passenger number detector explained above are shown in FIG. 11. As illustrated, the output signal may take either a linear or a stepped form as shown by the solid and dotted lines respectively so long as the signal is proportional to the actual number of boarding and alighting passengers.

Explanation will be made below of various devices for detecting traffic demand by the use of the above-described boarding passenger number detector and the alighting passenger number detector, referring to FIGS. 12 to 17. By way of explanation, the floors served include 10 floors from the first to the 10th floor, and like numerals or characters denote devices having like functions or like signals.

PD2U represents a boarding passenger number detector or an alighting passenger number detector for the 2nd floor up travel, and is generally called a boarding and alighting passenger number detector. $RAD_1$ to $RAD_4$ represent accumulators; $GAT_1$ to $GAT_7$ gate elements for passing therethrough input signals applied thereto to their output terminals only in response to the 1 state of the gate signal shown as an input arrow; $ADD_1$ to $ADD_4$ adders; REG a registr for storing and producing the input signal applied thereto; $DIV_1$, $DIV_2$ and $DIV_4$ to $DIV_6$ dividers; $COU_1$, $COU_3$ to $COU_5$ counters for counting and producing the number of input pulses; and $AND_3$ to $AND_8$ AND elements producing 1 signals only when all the respective input signals applied thereto are in the state of 1. S2U shows a pulse signal which becomes 1 upon completion of the calculating operation of the boarding and alighting passenger number detector PD2U, for example, immediately after the closing of the door, each time the car serves the 2nd floor for up travel (or, obviously, only when the car stops in response to a 2nd-floor up hall call if the boarding and alighting passenger number detector PD2U takes the form of the boarding passenger number detector, or only when the car stops in response to a 2nd-floor up cage call if the boarding and alighting passenger number detector PD2U is replaced by the alighting passenger number detector). Reference character T represents a signal for setting a demand detection period which takes the form of pulses in the state of 1 produced at regular intervals of T, say, every 1 week or month. Character CP represents clock pulses having a predetermined period, and H2U a hall call signal which maintains a 1 state as long as a 2nd-floor up hall call is registered. PT1 and PT3 represents traffic demand pattern signals which are in the state of 1 during the detecting operation of the traffic demand pattern detector as disclosed in an application Ser. No. 849,441, entitled "GROUP SUPERVISORY CONTROL SYSTEM FOR ELEVATORS", filed on Aug. 12, 1969 in the name of T. Yuminaka, et al and assigned to the same assignee as the present invention, now U.S. Pat. No. 3,642,099.

Figure 12:
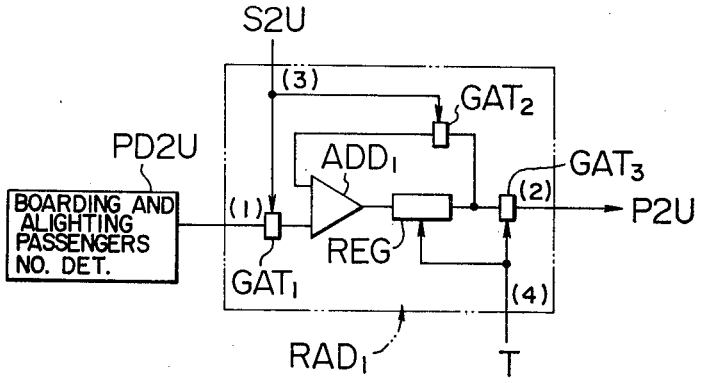

A circuit for calculating the number of boarding and alighting passengers for a predetermined period of time is shown in FIG. 12. The shown circuit is for the 2nd-floor up travel, and similar circuits are provided also for the remaining floors.

Each time a car leaves the 2nd floor upward after serving the same, a predetermined 1 pulse signal S2U is produced, so that the output of the boarding and alighting passenger number detector PD2U and the output of register REG are applied to the respective inputs of the adder $ADD_1$ for an adding operation through the gate elements $GAT_1$ and $GAT_2$ respectively. The output of the adder $ADD_1$ is applied to the register REG thereby to renew the information stored therein. In this way, the output of the register REG is a signal representing an accumulation of the output of the boarding and alighting passenger number detector PD2U each time of service of the 2nd floor up direction. After the lapse of a predetermined traffic demand detection period, a pulse signal T in the state of 1 is produced so that the information stored in the register REG is produced through the gate element $GAT_3$, and at the next moment, the register REG is cleared for the next traffic demand detection. As a result, the output P2U of the accumulator $RAD_1$ represents the number of boarding and alighting passengers for the 2nd floor up travel which is detected during the predetermined period of traffic demand detection period (which number is the number of prospective boarding passengers if the boarding and alighting passenger number detector PD2U takes the form of a boarding passenger number detector, or which number is the number of alighting passengers if the device PD2U is represented by an alighting passenger number detector). This number of boarding and alighting passengers for the 2nd floor up travel is renewed for each traffic demand detection period.

Figure 13:
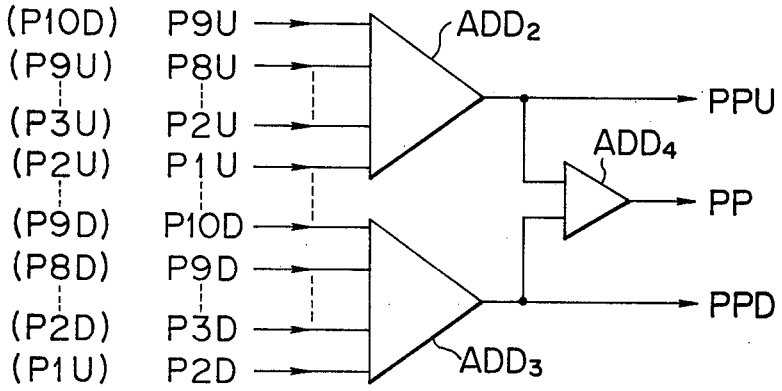

In FIG. 13, the signals P1U, P2U, . . . , P8U, P9U and P2D, P3D, . . . , P9D, P10D representing the boarding and alighting passenger numbers for the 1st floor up, 2nd floor up, . . . , 8th floor up, 9th floor up and 2nd floor down, 3rd floor down, . . . , 9th floor down, 10th floor down respectively are added by direction in the respective adders $ADD_2$ and $ADD_3$, the outputs of which are further added in the adder $ADD_4$. These adders $ADD_2$, $ADD_3$ and $ADD_4$ respectively produce output signals PPU, PPD and PP which represent the number of boarding and alighting passengers for up travel, and that for down travel and the total number of boarding and alighting passengers respectively. By the way, the symbols representing input signals to the adders $ADD_2$ and $ADD_3$ without any brackets are associated with the number of boarding passengers, whereas the symbols in the brackets denote the signals concerning the number of alighting passengers. This will be easily seen by noting the fact that at the top floor the prospective passengers take the car only for down travel, while the passengers alight only from the car arriving in up travel. (The reverse is the case for the bottom floor.)

Figure 14:
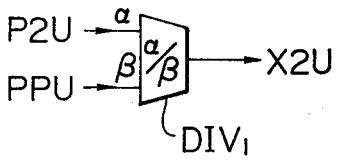

A circuit for calculating the rate of the number of boarding and alighting passengers for the 2nd floor up travel is shown in FIG. 14, a similar circuit being provided for each of the remaining floors.

The boarding and alighting passenger number signal P2U for the 2nd floor up travel calculated in FIG. 12 and the signal PPU representing the sum of the numbers of boarding and alighting passengers for up travel obtained from the circuit of FIG. 13 are applied to the divider $DIV_1$, wher the dividing operation P2U/PPU is performed. The output signal X2U from the divider $DIV_1$ represents the rate of the number of boarding and alighting passengers for the 2nd floor up travel to the total number of passengers travelling up. Generally, this signal is proportional to the rate of hall call generation with respect to the number of boarding passengers, and to the destination rate with respect to the number of alighting passengers.

Figure 15:
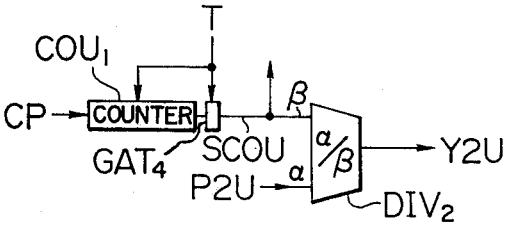

A circuit for calculating the number of boarding and alighting passengers for a unit time at the 2nd floor for up travel is shown in FIG. 15, a similar circuit being provided for each of the remaining floors.

The clock pulses CP are applied to the counter $COU_1$ which counts the number of such pulses. When a predetermined 1 signal T is produced after the lapse of a predetermined demand detection period an output signal SCOU from the counter $COU_1$ is applied through the gate element $GAT_4$ to the divider $DIV_2$. The output signal SCOU is proportional to the demand detection period. The 2nd-floor up boarding and alighting passenger number signal P2U calculated in the circuit of FIG. 12 is, on the other hand, also applied to the divider $DIV_2$ for conducting the dividing operation P2U/-SCOU. The resulting signal Y2U represents the number of passengers boarding and alighting at the 2nd floor for up travel per unit time. Generally, the number of passengers boarding a cage is called "passenger generation".

The number of boarding and alighting passengers each time of service at a given floor is also calculated by the same circuit configuration as the diagram of FIG. 15. For this purpose, what is required is to apply, instead of the clock pulses CP making up the input signal to the counter $COU_1$, the signal S2U of FIG. 12, to the counter $COU_1$. The signal S2U presents itself in the form of 1 pulse each time the car serves the floor involved, and therefore the output of the counter $COU_1$ counting the input pulses is a signal proportional to the number of times when the floor in question is served by the cars. In the description that follows, therefore, the output signal from the divider $DIV_2$ represents the number of boarding and alighting passengers for each car service.

In a typical building, traffic conditions vary with time through the day. In the morning rush hours, for example, a great number of people take the cars from the lobby floor while most passgengers in the cage get off at the other floors, with very few people getting on the cars at other than the lobby floors. The reverse is the case in the evening rush hours whn most of people leave their working places. In the intermediate hours, passengers are less in number than the morning or evening rush hours and both the boarding and alighting passengers are uniform number.

Figure 16:
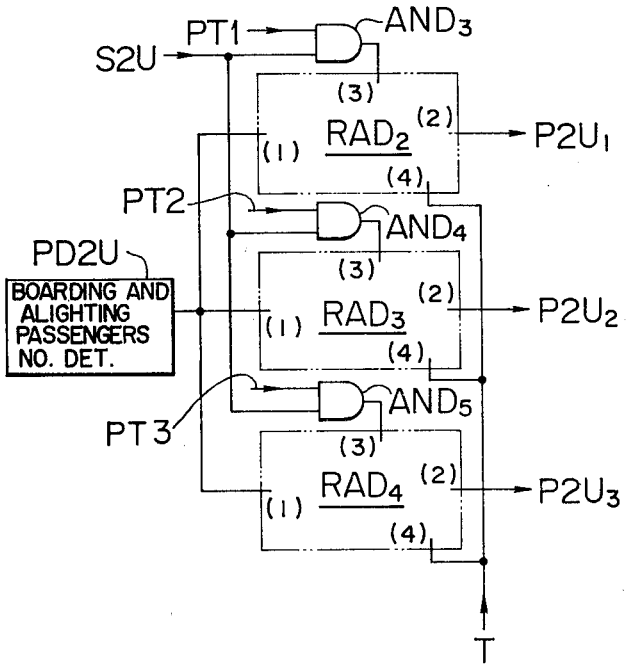

Circuits for calculating the traffic demand according to different patterns of traffic demand as mentioned above are shown in FIGS. 16 and 17. In this case, three traffic demand patterns PT1 to PT3 are included. Even though the signals obtained as in the above-mentioned U.S. Pat. No. 3,642,099 may be used as these traffic demand pattern signals PT1 to PT3, the demand patterns may alternatively be differentiated with the time of the day in view of the above-mentioned fact that the demand pattern depends to a considerable measure on the time of the day. FIG. 16 corresponds to FIG. 12, and FIG. 17 to FIG. 15. By the way, the accumulators $RAD_2$ to $RAD_4$ have the same construction as the accumulator $RAD_1$ and therefore their inner circuit construction will not be described again.

Assume that the traffic demand pattern signal PT1 is in the state of 1, while the other signals PT2 and PT3 are 0. Each time a car serves a 2nd-floor up call and leaves the 2nd floor, a predetermined pulse signal S2U in the stage of 1 is produced. Neither the AND element $AND_4$ nor $AND_5$, to which the other input signals PT2 and PT3 are 0, produces a 1 signal S2U at its output, while the 1 signal S2U is transferred only to the output of the AND element $AND_3$ since the input signal PT1 applied thereto is in the state of 1. As a result, the output signal from the boarding and alighting passenger number detector PD2U for the 2nd floor up travel, as explained with reference to FIG. 12, is accumulated only in the accumulator $RAD_2$ but not in the other accumulators $RAD_3$ and $RAD_4$.

In other words, as shown with reference to FIG. 12, the signals $P2U_1$ to $P2U_3$ produced from the accumulators $RAD_2$ to $RAD_4$ after the lapse of a predetermined traffic demand detection period are indicative of the boarding and alighting passenger number produced for the different traffic demand patterns for 2nd floor up travel.

Figure 17:
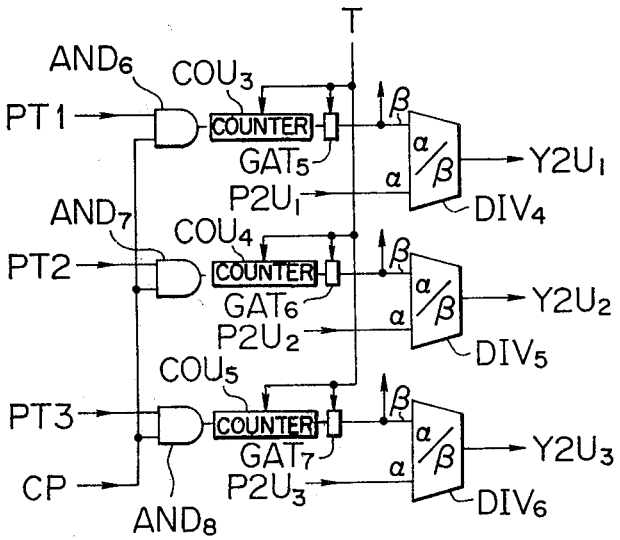

In FIG. 17, the clock pulses CP, like the signal S2U in FIG. 16, are transferred to the output of each of the AND elements $AND_6$ to $AND_8$ only when the corresponding traffic demand pattern signals PT1 to PT3 are in the state of 1, and then they are, applied to the counters $COU_3$ to $COU_5$ where they are counted.

As a result, as explained with reference to FIG. 15, the output signals of the counters $COU_3$ to $COU_5$ are applied to the dividers $DIV_4$ to $DIV_6$ through the gate elements $GAT_5$ to $GAT_7$, respectively, after the lapse of the predetermined demand detection period as the input signals ($\beta$) proportional to the time associated with the traffic demand patterns PT1 to PT3 respectively. The dividers $DIV_4$ to $DIV_6$, on the other hand, are respectively impressed with the signals $P2U_1$ to $P2U_3$ ($\alpha$) representative of the number of passengers associated with the traffic demand patterns PT1 to PT3 calculated and produced from the circuit of FIG. 16 so as to perform the dividing operation $\alpha/\beta$.

Therefore, the output signals $Y2U_1$ to $Y2U_3$ of the dividers $DIV_4$ to $DIV_6$ are the number of boarding and alighting passengers per unit time for the 2nd-floor up travel in accordance with the traffic demand patterns PT1 to PT3 respectively.

In this way, the number of passengers who got on or off for a predetermined period of time, the rates of the boarding and alighting passengers as distributed among the floors, the number of passengers who got on or off during a unit time, etc. are calculated and stored in a predetermined memory. The information thus stored in the memory is read out by the elevator control system as required and utilized as traffic information for elevator control.

In the above-mentioned embodiment, the various calculations for demand detection were carried out in response to each 1 state of the signal T representative of the demand detection period. The invention is not limited to such an embodiment, but may be easily so constructed that the various calculations are made continuously, not only during the period of generation of signal T. Also, even though the information stored in the register REG is reset by the signal T in the aforementioned embodiment, the various calculations may be conducted in response to the signal T without resetting the information in the register REG. In this case, the demand information for a longer period of time is stored in the register REG for improved detection accuracy.

Next, an application of the traffic demand detected by the invention will be briefly explained to help understand the invention.

It has recently been suggested that how many in-cage passengers are destined for which floors (hereinafter referred to as the "passenger numbers by destination") is detected from the number of in-cage passengers and the cage calls registered. (For details, see the U.S. Patent application Ser. No. 544,274 entitled "ELEVATOR CONTROL APPARATUS", filed on Jan. 27, 1975 in the name of T. IWASAKI, et al and assigned to the same assignee as the present invention.) A simple embodiment intended to achieve such an object is shown in the circuit diagram of FIG. 18. This diagram shows a circuit for detecting the number of passengers by destination for a car serving the 1st to 10th floors.

Figure 18:
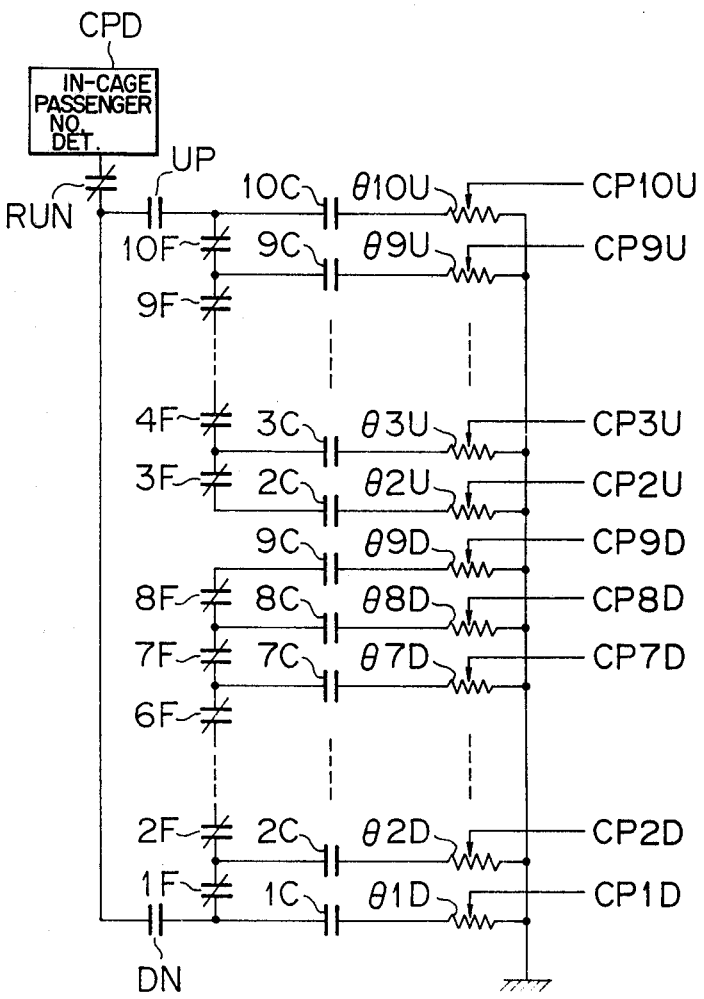
FIG. 18 is a circuit diagram showing an embodiment of the passenger-number-by-destination detector for explaining an application of the invention.

In FIG. 18, reference charactor CPD represents an in-cage passenger number detector, θ1D to θ9D and θ2U to θ10U variable resistors for setting rates at which the number of in-cage passengers is divided into the number of passengers by destination floor, RUN a contact which is cut off when the car is running. Characters UP and DN represent contacts which are closed when the car is running up and down respectively, 1F to 10F contacts which are cut off when the car is situated at the 1st to 10th floors respectively, and 1C to 10C contacts which are closed in response to the cage call registration for the 1st to 10th floors respectively.

The number of in-cage passengers detected by the in-cage passenger number detector CPD in the above-mentioned manner is divided, during the car stoppage, into the number of passengers by the destination floors associated with the registered cage calls with respect to the travelling direction of the car, in accordance with the rates set by the variable resistors θ1D to θ9D and θ2U to θ10U. In this way, the passenger numbers by destination CP1D to CP9D and to CP10U are detected.

Let use consider the case where the car is staying at the 4the floor for yp travel and cage calls for the 9th and 10th floors have been generated. The output of the in-cage passenger number detector CPD is applied to the variable resistors θ10U and θ9U through the path consisting of CPD, RUN, UP, 10F, 9C and θ9U and the path consisting of CPD, RUN, UP, 10C and θ10U, respectively. As a result, the passenger numbers by destination CP10U and CP9U are obtained from the output terminals of the variable resistors θ9U and θ10U, respectively, in accordance with the set rates.

In detecting the passenger numbers by destination CP10D to CP9D and CP2U to CP10U as mentioned above, the rates set by the variable resistors θ1D to θ9D and θ2U to θ10U are a very important requisite for the determination of accuracy in the detection of the passenger numbers by destination. As a rule, different floors in a building have different traffic conditions and different characters or behaviours of passengers. If the accuracy of detection of the passenger numbers by destination is to be improved, therefore, the rates to be set by the variable resistors is required to be determined taking into consideration the characters of the respective floors and the direction of the car, etc. For example, the rates should be set high for a specific floor and the lobby floor where passengers frequent more than the other floors, while it may be set low for the floors where passengers move less.

This invention may be used in setting the rates as mentioned above. For instance, the rates may be set by the use of the destination ratio explained with reference to FIG. 14 above. By using the invention with the passenger-numbers-by-destination detector, the detection accuracy may be improved for an improved elevator service.

Further, the traffic demand information detected according to the invention may be used appropriately as a factor for elevator control operation, thus improving the elevator control efficiency.

Although the embodiments of the invention have been explained above by reference to an ordinary circuit, an electronic computer has recently been introduced for the elevator control system. And this invention may be embodied digitally by the electronic computer on the basic of a similar principle.

What is claimed is:

1. An elevator car traffic demand detecting apparatus for a plurality of elevator cars serving a plurality of floors, comprising a first device for detecting the number of passengers boarding and alighting from each car each time the car serves each floor, a second device for detecting the floors served by the car, a third device for detecting the direction of travel of the car service, a fourth device supplied with at least the three outputs respectively from said first, second and third devices for detecting the number of boarding and alighting passengers by direction for each floor each time the car serves each floor, and a fifth device for accumulating, by floor and by direction, the numbers of boarding and alighting passengers by direction for each floor which are detected by said fourth device each time the car served each floor.

2. An apparatus according to claim 1, in which said first device includes a sixth device for detecting the number of prospective passengers waiting on each elevator hall and means for judging the number of hall-waiting prospective passengers detected by said sixth device at the time the car arrives at each floor to be the number of passengers boarding the car at the floor.

3. An apparatus according to claim 1, in which said first device includes a seventh device for detecting the number of passengers in the car, an eighth device for detecting the minimum number of passengers in the car during the time when the door is open at each floor, a ninth device for detecting the number of passengers in the car at the time the car leaves each floor, and means for detecting the number of passengers boarding the car at each floor by substracting said minimum number of passengers in the car from said number of passengers in the car at the time the car leaves each floor.

4. An apparatus according to claim 1, in which said first device includes a tenth device for detecting the number of passengers waiting at each floor, an eleventh device for detecting the number of passengers in the car, a twelfth device for adding each time the car arrived at each floor the number of passengers in the car and the number of passengers waiting at the floor to each other, means for detecting the number of passengers who alight from the car at each floor, by subtracting the number of passengers in the car at the time when the car leaves the floor from the result of said addition by said twelfth device.

5. An apparatus according to claim 1, in which said first device includes a thirteenth device for detecting the number of passengers in the car, a fourteenth device for detecting the number of passengers in the car at the time the car arrives at each floor, a fifteenth device for detecting the minimum number of passengers in the car during the time when the car door is open at each floor, and means for detecting the number of passengers alighting from the car at each floor by substracting said minimum number of passengers in the car from the number of passengers in the car at the time the car arrives at the floor.

6. An apparatus according to claim 1, further comprising a sixteenth device for setting different traffic demand patterns and a seventhteeth device for classifying, according to said different traffic demand patterns, the number of boarding and alighting passagers detected for each floor each time the car serves the floor, so as to accumulate the numbers of boarding and alighting passengers by floor and by direction for each of said different traffic demand patterns.

7. An apparatus according to claim 1, further comprising an eighteenth device adapted to be supplied with said accumulated boarding and alighting passenger number by direction for each floor for calculating the total number of boarding and alighting passengers by direction by adding the numbers of boarding and alighting passengers by direction for the respective floors.

8. An apparatus according to claim 7, further comprising a ninteenth device for calculating the rate of the boarding and alighting passengers by direction for a given floor from the ratio between said total number of boarding and alighting passengers by direction and said accumulated number of boarding and alighting passengers by direction for said given floor.

9. An apparatus according to claim 1, further comprising a twentieth device for generating a unit time signal every unit time and a twenty-first device for calculating the number of boarding and alighting passengers per unit time by floor by direction from the output of said fifth device and the unit time signal from said twentieth device.

10. An apparatus according to claim 6, further comprising a twenty-second device adapted to be supplied with the accumulated number of boarding and alighting passengers by direction for each floor for each of said traffic demand patterns, for calculating the total number of boarding and alighting passengers by direction for each of said traffic demand patterns by adding the numbers of boarding and alighting passengers for the respective floors by direction according to each traffic demand pattern.

11. An apparatus according to claim 10, further comprising a twenty-third device for calculating the rate of the boarding and alighting passengers by direction for a given floor according to each of said traffic demand patterns, from the ratio between the total number of boarding and alighting passengers by direction according to each of said traffic demand patterns and the number of boarding and alighting passengers by direction for said given floor accumulated for each of said traffic demand patterns.

12. An apparatus according to claim 6, further comprising a twenty-fourth device for generating a unit time signal every unit time and a twenty-fifth device for calculating the number of boarding and alighting passengers per unit time by direction for each floor according to each of said traffic demand patterns on the basis of said output of said seventeenth device and the unit time signal from said twenty-fourth device.

* * * * *